US012590253B2

(12) United States Patent
Anderson et al.

(10) Patent No.: US 12,590,253 B2
(45) Date of Patent: Mar. 31, 2026

(54) LOW CARBON FOOTPRINT INTEGRATED PROCESS FOR RECYCLE CONTENT OLEFIN PRODUCERS

(71) Applicant: ExxonMobil Product Solutions Company, Spring, TX (US)

(72) Inventors: Avery L. Anderson, Longview, TX (US); Daryl Bitting, Longview, TX (US); Michael Gary Polasek, Longview, TX (US); David Eugene Slivensky, Tatum, TX (US); Xianchun Wu, Longview, TX (US)

(73) Assignee: ExxonMobil Product Solutions Company, Spring, TX (US)

( * ) Notice: Subject to any disclaimer, the term of this patent is extended or adjusted under 35 U.S.C. 154(b) by 246 days.

(21) Appl. No.: 18/692,880

(22) PCT Filed: Sep. 16, 2022

(86) PCT No.: PCT/US2022/043749
§ 371 (c)(1),
(2) Date: Mar. 18, 2024

(87) PCT Pub. No.: WO2023/049032
PCT Pub. Date: Mar. 30, 2023

(65) Prior Publication Data

US 2025/0136873 A1 May 1, 2025

Related U.S. Application Data

(60) Provisional application No. 63/261,418, filed on Sep. 21, 2021.

(51) Int. Cl.
*C10G 1/10* (2006.01)

(52) U.S. Cl.
CPC ..... *C10G 1/10* (2013.01); *C10G 2300/1003* (2013.01); *C10G 2300/207* (2013.01); *C10G 2300/4043* (2013.01)

(58) Field of Classification Search
CPC ..... C10G 1/10; C10G 2300/1003; C10G 2300/207; C10G 2300/4043
See application file for complete search history.

(56) References Cited

U.S. PATENT DOCUMENTS 3,544,291 A 12/1970 Schlinger et al.
4,220,454 A 9/1980 Ban et al.
(Continued)

FOREIGN PATENT DOCUMENTS

CN 1434015 A 8/2003
CN 203582812 U 5/2014
(Continued)

OTHER PUBLICATIONS

Co-pending U.S. Appl. No. 17/083,592, filed Oct. 29, 2020; Wu. et al.

(Continued)

*Primary Examiner* — Ellen M Mcavoy
(74) *Attorney, Agent, or Firm* — C. Tumey Law Group PLLC

(57) ABSTRACT

Integrated processes and facilities for providing recycled content hydrocarbon products (r-products) from mixed waste plastic are provided. Carbon dioxide capture and energy recovery from one or more process streams described herein increase energy efficiency and help reduce overall environmental impact while producing valuable final products from chemically recycled waste plastic.

20 Claims, 4 Drawing Sheets

(56) References Cited

U.S. PATENT DOCUMENTS

| | | | | |
|---|---|---|---|---|
| 4,588,850 | A | 5/1986 | Mueller et al. | |
| 5,087,763 | A | 2/1992 | Sorensen | |
| 5,792,340 | A | 8/1998 | Freel et al. | |
| 5,841,011 | A | 11/1998 | Hashimoto et al. | |
| 5,904,879 | A | 5/1999 | Winter et al. | |
| 7,453,393 | B2 | 11/2008 | Duivenvoorden | |
| 7,531,618 | B2 | 5/2009 | DeBruin | |
| 8,183,422 | B2 | 5/2012 | Alegria et al. | |
| 8,895,790 | B2 | 11/2014 | Narayanaswamy et al. | |
| 9,096,801 | B2 | 8/2015 | Baker | |
| 10,246,643 | B2 | 4/2019 | Gephart et al. | |
| 10,655,070 | B2 | 5/2020 | Wheeler et al. | |
| 2006/0251547 | A1 | 11/2006 | Windes et al. | |
| 2007/0179326 | A1 | 8/2007 | Baker | |
| 2009/0093600 | A1 | 4/2009 | Moore et al. | |
| 2014/0228606 | A1 | 8/2014 | Narayanaswamy et al. | |
| 2016/0122190 | A1 | 5/2016 | Schmelzer et al. | |
| 2016/0264874 | A1 | 9/2016 | Narayanaswamy et al. | |
| 2016/0264885 | A1 | 9/2016 | Narayanaswamy et al. | |
| 2017/0158503 | A1 | 6/2017 | Foody et al. | |
| 2017/0283707 | A1 | 10/2017 | Gephart et al. | |
| 2019/0161683 | A1 | 5/2019 | Narayanaswamy et al. | |
| 2019/0390124 | A1 | 12/2019 | Oprins et al. | |
| 2020/0017772 | A1 | 1/2020 | Ramamurthy et al. | |
| 2020/0362248 | A1 | 11/2020 | Cartolano et al. | |
| 2021/0130699 | A1 | 5/2021 | Bitting et al. | |
| 2021/0130708 | A1 | 5/2021 | Xu et al. | |
| 2021/0130710 | A1 | 5/2021 | Xu et al. | |
| 2021/0130712 | A1 | 5/2021 | Abudawoud et al. | |
| 2021/0130713 | A1 | 5/2021 | Xu et al. | |
| 2021/0130714 | A1 | 5/2021 | Abudawoud et al. | |
| 2021/0130715 | A1 | 5/2021 | Xu et al. | |
| 2021/0130717 | A1 | 5/2021 | Xu et al. | |
| 2023/0089058 | A1* | 3/2023 | Polasek | C10G 53/02 585/241 |
| 2023/0139587 | A1* | 5/2023 | DeBruin | C08J 11/12 252/373 |
| 2023/0357643 | A1* | 11/2023 | Pasanen | C10G 9/36 |
| 2025/0135392 | A1* | 5/2025 | Wu | C10G 1/10 |
| 2025/0340793 | A1* | 11/2025 | Bitting | C10G 57/00 |

FOREIGN PATENT DOCUMENTS

| | | | |
|---|---|---|---|
| CN | 105238434 | B1 | 3/2017 |
| CN | 112760116 | A | 5/2021 |
| FI | 20 205 131 | A1 | 12/2020 |
| JP | 07-216364 | A | 8/1995 |
| JP | 2000176403 | A | 6/2000 |
| JP | 2000313892 | A | 11/2000 |
| JP | 2018-511671 | A | 4/2018 |
| KR | 10-2000-0023759 | A | 4/2000 |
| WO | WO 95/09902 | A1 | 4/1995 |
| WO | WO 2004/018592 | A1 | 3/2004 |
| WO | WO 2010/051013 | A1 | 5/2010 |
| WO | WO 2010/062307 | A1 | 6/2010 |
| WO | WO 2015/100430 | A1 | 7/2015 |
| WO | WO 2016/142809 | A1 | 9/2016 |
| WO | WO 2017/146876 | A1 | 8/2017 |
| WO | WO 2018/005074 | A1 | 1/2018 |
| WO | WO 2018/055555 | A1 | 3/2018 |
| WO | WO 2018/069794 | A1 | 4/2018 |
| WO | WO 2019/056138 | A1 | 3/2019 |
| WO | WO 2020/252228 | A1 | 12/2020 |
| WO | WO 2021/063961 | A1 | 4/2021 |
| WO | WO 2021/084016 | A1 | 5/2021 |
| WO | WO 2021/087038 | A1 | 5/2021 |
| WO | WO 2021/087057 | A1 | 5/2021 |
| WO | WO 2021/087066 | A1 | 5/2021 |
| WO | WO 2021/163094 | A1 | 8/2021 |
| WO | WO 2021/163113 | A1 | 8/2021 |
| WO | WO 2021/163123 | A1 | 8/2021 |

OTHER PUBLICATIONS

USPTO Office action dated Feb. 3, 2022 received in co-pending U.S. Appl. No. 17/083,592.
USPTO Office Action dated Sep. 12, 2022 received in co-pending U.S. Appl. No. 17/083,592.
USPTO Offce Action dated Oct. 19, 2023 received in co-pending U.S. Appl. No. 17/083,592.
Co-pending U.S. Appl. No. 17/995,713, filed Oct. 7, 2022; DeBruin et al.
Co-pending U.S. Appl. No. 18/692,913, filed Mar. 18, 2024; Polasek et al.
Co-pending U.S. Appl. No. 18/691,476, filed Mar. 13, 2024; Wu et al.
Co-pending U.S. Appl. No. 18/692,880, filed Mar. 18, 2024; Aderson et al.
Co-pending U.S. Appl. No. 18/692,904, filed Mar. 18, 2024; Aderson et al.
Co-pending U.S. Appl. No. 18/691,481, filed Mar. 13, 2024; Slivensky et al.
Co-pending U.S. Appl. No. 18/691,643, filed Mar. 13, 2024; Slivensky et al.
Co-pending U.S. Appl. No. 18/691,596, filed Mar. 13, 2024; Slivensky et al.
Co-pending U.S. Appl. No. 18/691,596, filed Mar. 13, 2024; Wu et al.
Notification of Transmittal of the International Search Report and the Written Opinion of the International Searching Authority with Date of Mailing Jul. 30, 2021 for International Application No. PCT/US2021/027007.
Notification of Transmittal of the International Search Report and the Written Opinion of the International Searching Authority with Date of Mailing Aug. 25, 2022 for International Application No. PCT/US2022/026679.
Notification of Transmittal of the International Search Report and the Written Opinion of the International Searching Authority with Date of Mailing Dec. 9, 2022 for International Application No. PCT/US2022/043746.
Notification of Transmittal of the International Search Report and the Written Opinion of the International Searching Authority with Date of Mailing Dec. 13, 2022 for International Application No. PCT/US2022/043744.
Notification of Transmittal of the International Search Report and the Written Opinion of the International Searching Authority with Date of Mailing Dec. 19, 2022 for International Application No. PCT/US2022/043755.
Notification of Transmittal of the International Search Report and the Written Opinion of the International Searching Authority with Date of Mailing Dec. 28, 2022 for International Application No. PCT/US2022/043749.
Notification of Transmittal of the International Search Report and the Written Opinion of the International Searching Authority with Date of Mailing Dec. 30, 2022 for International Application No. PCT/US2022/043747.
Notification of Transmittal of the International Search Report and the Written Opinion of the International Searching Authority with Date of Mailing Jan. 2, 2023 for International Application No. PCT/US2022/043751.
Notification of Transmittal of the International Search Report and the Written Opinion of the International Searching Authority with Date of Mailing Feb. 24, 2023 for International Application No. PCT/US2022/043753.
Notification of Transmittal of the International Search Report and the Written Opinion of the International Searching Authority with Date of Mailing Feb. 27, 2023 for International Application No. PCT/US2022/043743.
ASTMD2887; "Standard Test Method for Boiling Range Distribution of Petroleum Fractions by Gas Chromatography"; Published Dec. 2023.
ASTMD5399; "Standard Test Method for Boiling Point Distribution of Hydrocarbon Solvents by Gas Chromatography"; Published Aug. 2023.

* cited by examiner

LOW CARBON FOOTPRINT INTEGRATED PROCESS FOR RECYCLE CONTENT OLEFIN PRODUCERS

CROSS-REFERENCE TO RELATED APPLICATION(S)

This application is a national stage filing under 35 USC § 371 of International Application Number PCT/US2022/043749, filed on, Sep. 16, 2022 which claims the benefit of the filing date to U.S. Provisional Application No. 63/261,418, filed on Sep. 21, 2021, the entire disclosures of which are incorporated by reference herein.

BACKGROUND

Waste plastic pyrolysis plays a part in a variety of chemical recycling technologies. Typically, waste plastic pyrolysis facilities produce recycled content pyrolysis oil (r-pyoil) and recycled content pyrolysis gas (r-pygas) that can be further processed to provide a variety of recycled content chemical products and intermediates, such as recycled content ethylene (r-ethylene), recycled content ethane (r-ethane), recycled content propylene (r-propylene), recycled content propane (r-propane) and others. Unfortunately, under conventional operation, interconnected pyrolysis and product separation facilities can lack energy efficiency, which can be costly from both a financial and environmental standpoint.

However, when pyrolysis facilities are added to an existing downstream facility, such as a cracking facility, the carbon footprint of the resulting combined facilities is typically not optimized, since the primary focus is on the production of specific recycled content products. Consequently, even though recycled content products are being produced by these combined facilities, the environmental impact, including energy consumption, of the combined facilities may not be thoroughly analyzed to minimize areas like the amount of carbon dioxide released into the environment and/or the energy intensity of the facility. Therefore, these facilities may exhibit one or more process deficiencies that negatively impact the global warming potential of the combined facilities. Thus, a processing scheme for waste plastic pyrolysis and subsequent separation of recycled content hydrocarbon stream that provides a lower carbon footprint, while still maximizing recycled content, is needed.

For example, when integrating cracking and pyrolysis, there are many energy inefficiencies in conventional facilities that increase the overall carbon footprint of the facility. For example, there may locations within the facility where energy is lost, while other locations require additional energy input, which usually means combustion of fossil fuels. Thus, a processing scheme is needed that maximizes use of the recycled content from waste plastic while also enhancing energy efficiency, particularly in an integrated facility.

SUMMARY

In one aspect, the present technology concerns a chemical recycling process for making a recycled content hydrocarbon product (r-product), the process comprising: (a) liquefying a plastic in a liquification zone to provide a liquified waste plastic; (b) pyrolyzing at least a portion of the liquified waste plastic in a pyrolysis furnace of a pyrolysis facility to produce a recycled content pyrolysis vapor (r-pyrolysis vapor); (c) introducing at least a portion of the r-pyrolysis vapor into a separation zone downstream of a cracker furnace in a cracking facility; and (d) separating at least a portion of the r-pyrolysis vapor in the separation zone to provide the recycled content hydrocarbon product, wherein at least one of following steps (i) through (iii) is also performed—(i) passing at least a portion of a flue gas from the pyrolysis furnace and/or the cracker furnace through a carbon dioxide removal zone to capture at least a portion of the carbon dioxide; (ii) recovering energy from a flue gas from the pyrolysis furnace and/or the cracker furnace and using at least a portion of the recovered energy to perform the liquefying of step (a); and (iii) recovering an off-gas stream from the separation zone in the cracking facility and using at least a portion of the off-gas stream as fuel in the pyrolysis and/or cracker furnace.

In one aspect, the present technology concerns a process for making a recycled content hydrocarbon product (r-product), the process comprising: (a) separating mixed waste plastic in a mixed plastic waste (MPW) separator into a polyolefin-enriched (PO-enriched) fraction and a polyolefin-depleted (PO-depleted) fraction; (b) liquefying at least a portion of the PO-enriched fraction in a liquification zone to provide a liquified waste plastic; (c) pyrolyzing at least a portion of the liquified waste plastic in a pyrolysis furnace of a pyrolysis facility to produce a recycled content pyrolysis vapor (r-pyrolysis vapor); (d) introducing at least a portion of the r-pyrolysis vapor into a separation zone downstream of a cracker furnace in a cracking facility; and (e) separating at least a portion of the r-pyrolysis vapor in the separation zone to provide the recycled content hydrocarbon product, wherein at least one of following steps (i) through (iii) is also performed—(i) passing at least a portion of a flue gas from the pyrolysis furnace and/or the cracker furnace through a carbon dioxide removal zone to recover at least a portion of the carbon dioxide; (ii) recovering thermal energy from a flue gas from the pyrolysis furnace and/or the cracker furnace and transferring at least a portion of said thermal energy to said liquification zone; and (iii) recovering an off-gas stream from the separation zone in the cracking facility and combusting at least a portion of the off-gas stream as fuel in the pyrolysis and/or cracker furnace.

In one aspect, the present technology concerns a process for making a recycled content hydrocarbon product (r-product), the process comprising: (a) separating mixed waste plastic into a polyolefin-enriched (PO-enriched) fraction and a polyolefin-depleted (PO-depleted) fraction; (b) liquefying at least a portion of the PO-enriched fraction in a liquification zone to provide a liquified waste plastic; (c) pyrolyzing at least a portion of the liquified waste plastic in a pyrolysis furnace of a pyrolysis facility to produce a recycled content pyrolysis vapor (r-pyrolysis vapor); (d) separating at least a portion of the r-pyrolysis vapor to provide a recycled content pyrolysis gas (r-pygas) and a recycled content pyrolysis oil (r-pyoil); (e) introducing at least a portion of the r-pygas into a separation zone downstream of a cracker furnace in a cracking facility and/or introducing at least a portion of the r-pyoil into an inlet the cracker furnace in the cracking facility; and (f) separating at least a portion of an effluent stream from the cracker furnace in the separation zone to provide the recycled content hydrocarbon product (r-hydrocarbon product), wherein at least one of following steps (i) through (iii) is also performed—(i) passing at least a portion of a flue gas from the pyrolysis furnace and/or the cracker furnace through a carbon dioxide removal zone to recover at least a portion of the carbon dioxide; (ii) recovering thermal energy from a flue gas from the pyrolysis furnace and/or the cracker furnace and transferring at least a portion of said thermal energy to said liquification zone; and (iii) recovering an off-gas stream from the separation zone in the cracking facility and combusting at least a portion of the off-gas stream as fuel in the pyrolysis and/or cracker furnace.

DETAILED DESCRIPTION

We have discovered ways of optimizing an integrated chemical recycling facility as described herein. In particular, we have found methods of recovering waste heat and/or capturing carbon dioxide from process effluent streams that both enhances the energy efficiency of the facility, as well as reduces its carbon emissions. As a result, an integrated facility as described herein is capable of producing valuable recycled content products (such as olefins), with less energy input and reduced emissions.

Figure 1:
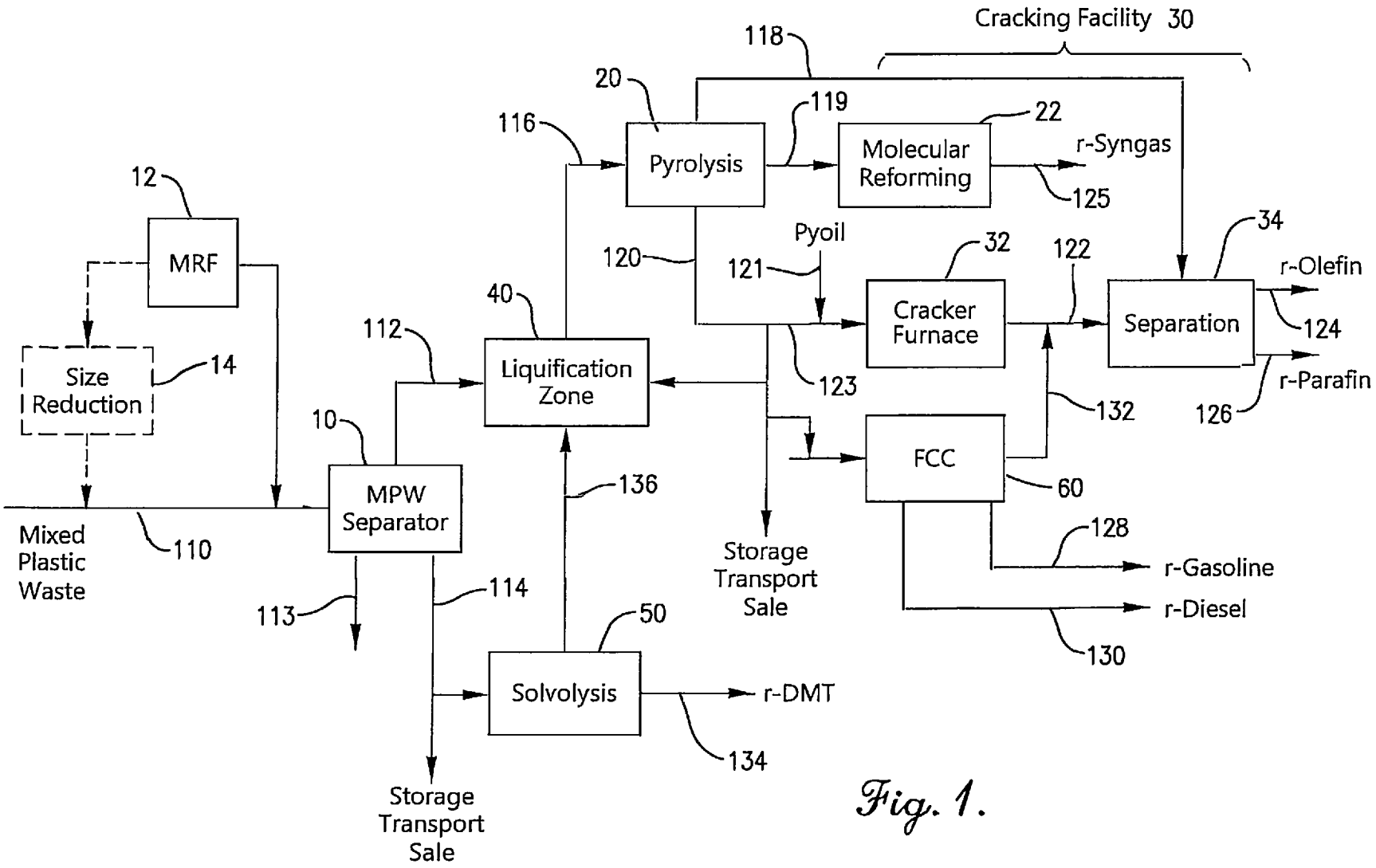
FIG. 1 is a block flow diagram illustrating the main steps of a process and facility for chemical recycling waste plastic to provide one or more recycled content products.

Turning first to FIG. 1, an integrated process and system for use in chemical recycling of waste plastic is provided. The process/facility shown in FIG. 1 includes a mixed plastic waste (MPW) separating step/facility 10, a liquification zone 40, a pyrolysis step/facility 20, a cracking step/facility 30, an optional solvolysis step/facility 50, an optional fluidized catalytic cracking (FCC) step/facility 60, and an optional molecular reforming step/facility 22. The MPW separating step/facility 10 receives mixed waste plastic from, for example, a municipal recycling facility (MRF) 12 and separates it into a stream enriched in polyethylene terephthalate (PET) plastic 114 and a stream enriched in polyolefin (PO) plastic 112. At least a portion of the PO-enriched plastic 112 can be liquified in a liquification zone 40 and then pyrolyzed in a pyrolysis step/facility 20. One or more recycled content streams from the pyrolysis step/facility 20 can be further processed in a cracking step/facility 30, a molecular reforming step/facility 22, and/or FCC step/facility 60 to form one or more recycled content product streams. At least a portion of the PET-enriched plastic 114 can optionally subjected to further chemical processing (e.g., solvolysis in a solvolysis step/facility 50) to provide recycled content dimethyl terephthalate (r-DMT), with one or more co-products from the processing being further integrated into the recycling facility. Additional details regarding specific configurations of portions of this facility are discussed in detail below, with respect to FIGS. 2A-2C, and provide additional energy efficiency and/or reduced carbon footprint.

Referring again to FIG. 1, at least two, at least three, at least four, or all of the MPW step/facility 10, pyrolysis step/facility 20, cracking step/facility 30, liquification zone/step 40, and optional solvolysis step/facility 50, optional molecular reforming facility 22, and optional FCC step/facility 60 (when present) can be co-located. As used herein, the term "co-located" refers to the characteristic of at least two objects being situated on a common physical site, and/or within 1, within 0.75, within 0.5, or within 0.25 miles of each other, measured as a straight-line distance between two designated points. When two or more facilities are co-located, the facilities may be integrated in one or more ways. Examples of integration include, but are not limited to, heat integration, utility integration, waste-water integration, mass flow integration via conduits, office space, cafeterias, integration of plant management, IT department, maintenance department, and sharing of common equipment and parts, such as seals, gaskets, and the like.

In some embodiments, at least two, at least three, at least four, or all of the MPW step/facility 10, pyrolysis step/facility 20, cracking step/facility 30, liquification zone/step 40, and optional solvolysis step/facility 50, optional molecular reforming facility 22, and optional FCC step/facility 60 (when present) can be located remotely from one another. As used herein, the term "located remotely" refers to a distance of greater than 1, greater than 5, greater than 10, greater than 50, greater than 100, greater than 500, greater than 1000, or greater than 10,000 miles between two facilities, sites, or reactors. Whether co-located or located remotely, two or more, three or more, four or more, or all of the facilities may be owned and operated by the same commercial entities, or by different commercial entities.

In some embodiments, the pyrolysis step/facility 20 is a commercial scale step/facility receiving the waste plastic feedstock 110 at an average annual feed rate of at least 100, or at least 500, or at least 1,000, at least 2,000, at least 5,000, at least 10,000, at least 50,000, or at least 100,000 pounds per hour, averaged over one year. Further, the pyrolysis step/facility 20 can produce the one or more recycled content product streams at an average annual rate of at least 100, or at least 1,000, or at least 5,000, at least 10,000, at least 50,000, or at least 75,000 pounds per hour, averaged over one year. When more than one r-product stream is produced, these rates can apply to the combined rate of all r-products.

Similarly, the cracking step/facility 30 can be a commercial scale step/facility receiving hydrocarbon feed at an average annual feed rate of at least at least 100, or at least 500, or at least 1,000, at least 2,000, at least 5,000, at least 10,000, at least 50,000, or at least 75,000 pounds per hour, averaged over one year. Further, the cracking step/facility 30 can produce at least one recycled content product stream 122 at an average annual rate of at least 100, or at least 1,000, or at least 5,000, at least 10,000, at least 50,000, or at least 75,000 pounds per hour, averaged over one year. When more than one r-product stream is produced, these rates can apply to the combined rate of all r-products.

In some embodiments, one or more of the solvolysis step/facility 50, the molecular reforming facility 22, and the FCC step/facility 60 may also be a commercial scale step/facility and can receive feed at an average annual feed rate of at least at least 100, or at least 500, or at least 1,000, at least 2,000, at least 5,000, at least 10,000, at least 50,000, or at least 75,000 pounds per hour, averaged over one year. Further, the solvolysis step/facility 50, the molecular reforming step/facility 22, and/or FCC step/facility 60 can produce at least one recycled content product stream 122 at an average annual rate of at least 100, or at least 1,000, or at least 5,000, at least 10,000, at least 50,000, or at least 75,000 pounds per hour, averaged over one year. When more than one r-product stream is produced, these rates can apply to the combined rate of all r-products.

As shown in FIG. 1, the process starts with a stream of mixed plastic waste (MPW) 110 introduced into the MPW separating step/facility 10. In some embodiments, the MPW can include at least 50, at least 75, at least 90, or at least 95 weight percent of at least one polyolefin (PO) and/or at least 50, at least 75, at least 90, or at least 95 weight percent of at least one polyester, including polyethylene terephthalate (PET). Examples of polyolefins can include, but are not limited to, high density polyethylene, low density polyethylene, and polypropylene. Examples of polyesters can include, but are not limited to, PET, PEN, and modified PET including at least one modifying glycol and/or acid.

In some embodiments, at least a portion of the MPW can come from a municipal recycling facility (MRF) 12, and it may or may not be subjected to an optional size reduction step/zone 14, shown in FIG. 1. When present, the size reduction step/zone 14 can utilize any suitable process for reducing the size of the MPW and can be conducted with any mixing, shearing, or grinding device. The particle size of the MPW introduced into the size reduction step/zone 14 can be reduced by at least 50, at least 60, at least 70, at least 80, at least 90, or at least 95 percent.

In some embodiments, impurities such as cardboard, paper, dirt, sand, and glass, as well as other plastics such as nylons and halogen-containing polymers, can be removed prior to being introduced into the MPW step/facility 10. In other cases, the MPW step/facility 10 can include an impurity separation step (not shown in FIG. 1) for removing a stream of impurities 113 from the process/zone.

In the MPW separating step/facility 10, the mixed waste plastic feed can be separated to form a PO-enriched plastic stream 112 and a PET-enriched plastic stream 114. Any suitable separation technique can be used including, for example, manual separation, density separation including gravity separation by air, wet sink-float separation, or hydrocyclone, electrostatic separation, and sensor-based separation. The resulting PO-enriched stream 112 can include at least 75, at least 90, or at least 95 weight percent PO, and the PET-enriched stream can include at least 75, at least 90, or at least 95 weight percent PET. The PO-enriched stream 112 can include less than 10, less than 5, less than 2, or less than 1 wight percent polyesters (e.g., PET). Low levels of PET in the PO-enriched stream 112 help minimize corrosion in downstream equipment.

As shown in FIG. 1, at least a portion of the PO-enriched stream 112 can be introduced into a liquification step/zone 40. The liquification step/zone 40 may comprise a process for liquifying the waste plastic by one or more of: (i) heating/melting; (ii) dissolving in a solvent; (iii) depolymerizing; (iv) plasticizing, and combinations thereof. Additionally, one or more of options (i) through (iv) may also be accompanied by the addition of a blending agent to help facilitate the liquification (reduction of viscosity) of the polymer material.

In some embodiments, the liquification step/zone 40 includes at least a melt tank and a heater. The melt tank receives the waste plastic feed and the heater heats waste plastic stream. The melt tank can include one or more continuously stirred tanks. When one or more rheology modification agents (e.g., solvents, depolymerization agents, plasticizers, and blending agents) are used in the liquification zone, such rheology modification agents can be added to and/or mixed with the waste plastic in the melt tank. The heater of the liquification zone can take the form of internal heat exchange coils located in the melt tank and/or an external heat exchanger. The heater may transfer heat to the waste plastic via indirect heat exchange with a process stream or heat transfer medium, such as in the heat integration processes described in greater detail below with respect to FIG. 2B.

As shown in FIG. 1, in some embodiments, the waste plastic or liquified waste plastic 116 is fed to a pyrolysis step/facility 20 where the waste plastic is pyrolyzed in a pyrolysis reactor. The pyrolysis reaction involves chemical and thermal decomposition of sorted waste plastic introduced into the reactor. Although all pyrolysis processes may be generally characterized by a reaction environment that is substantially free of oxygen, pyrolysis processes may be further defined by other parameters such as the pyrolysis reaction temperature within the reactor, the residence time in the pyrolysis reactor, the reactor type, the pressure within the pyrolysis reactor, and the presence or absence of pyrolysis catalysts.

In some embodiments, the peak pyrolysis temperature in the pyrolysis reactor can range from 325 to 800° C., or 350 to 600° C., or 375 to 500° C., or 390 to 450° C., or 400 to 500° C., and the residence time of the feedstock within the pyrolysis reactor can range from 1 second to 1 hour, or 10 seconds to 30 minutes, or 30 seconds to 10 minutes. The pressure within the pyrolysis reactor can be maintained at atmospheric pressure or within the range of 0.1 to 60, or 0.2 to 10, or 0.3 to 1.5 barg. The pyrolysis reaction can be thermal pyrolysis, which is carried out in the absence of catalyst, or catalytic pyrolysis, which can be performed in the presence of a catalyst such as, for example, zeolites or other mesostructured materials.

As shown in FIG. 1, a stream of recycled content pyrolysis vapor (r-pyrolysis vapor) may be withdrawn from a pyrolysis reactor (not shown) and separated into two or more product streams, including, for example, recycled content pyrolysis gas (r-pygas) 118 and recycled content pyrolysis oil (r-pyoil) 120. Additionally, a stream of recycled content pyrolysis residue (r-pyrolysis residue) 119 may also be removed from the pyrolysis step/facility 20. As used herein, the terms "pyrolysis gas" or "pygas" refers to a composition obtained from waste plastic pyrolysis that is gaseous at 25° C. at 1 atm. As used herein, the terms "pyrolysis oil" or "pyoil" refers to a composition obtained from waste plastic pyrolysis that is liquid at 25° C. and 1 atm. As used herein, the term "pyrolysis residue" refers to a composition obtained from waste plastic pyrolysis that is not pygas or pyoil and that comprises predominantly pyrolysis char and pyrolysis heavy waxes. As used herein, the term "pyrolysis char" refers to a carbon-containing composition obtained from pyrolysis that is solid at 200° C. and 1 atm. As used herein, the term "pyrolysis heavy waxes" refers to C20+ hydrocarbons obtained from pyrolysis that are not pyrolysis char, pyrolysis gas, or pyrolysis oil. In some embodiments, the r-pygas stream 118 comprises 1 to 50 weight percent methane and/or 5 to 99 weight percent C2, C3, and/or C4 hydrocarbon content (including all hydrocarbons having 2, 3, or 4 carbon atoms per molecule). The r-pygas stream 118 may comprise C2 and/or C3 components each in an amount of 5 to 60, 10 to 50, or 15 to 45 weight percent, C4 components in an amount of 1 to 60, 5 to 50, or 10 to 45 weight percent, and C5 components in an amount of 1 to 25, 3 to 20, or 5 to 15 weight percent.

In some embodiments, the r-pyoil stream 120 comprises at least 50, at least 75, at least 90, or at least 95 weight percent of C4 to C30, C5 to C25, C5 to C22, or C5 to C20 hydrocarbon components. The r-pyoil can have a 90% boiling point in the range of from 150 to 350° C., 200 to 295° C., 225 to 290° C., or 230 to 275° C. As used herein, "boiling point" refers to the boiling point of a composition as determined by ASTM D2887-13. Additionally, as used herein, an "90% boiling point," refers to a boiling point at which 90 percent by weight of the composition boils per ASTM D-2887-13.

In some embodiments, the r-pyoil can comprise heteroatom-containing compounds in an amount of less than 20, less than 10, less than 5, less than 2, less than 1, or less than 0.5 weight percent. As used herein, the term "heteroatom-containing" compound includes any compound or polymer containing nitrogen, sulfur, or phosphorus. Any other atom is not regarded as a "heteroatom" for purposes of determining the quantity of heteroatoms, heterocompounds, or heteropolymers present in the pyoil. Heteroatom-containing compounds include oxygenated compounds. Often, such compounds exist in r-pyoil when the pyrolyzed waste plastic includes polyethylene terephthalate (PET) and/or polyvinyl chloride (PVC). Thus, little to no PET and/or PVC in the waste plastic 110 results in little to no heteroatom-containing compounds in the pyoil.

In some embodiments, the r-pyrolysis residue 119 may be introduced into a molecular reforming facility 22, wherein at least a portion of the r-pyrolysis residue 119 can be converted to recycled content synthesis gas (r-syngas) 125. As used herein, the term "molecular reforming" refers to conversion of a carbon-containing feed into syngas (CO, CO2, and H2). Molecular reforming encompasses both steam reforming and partial oxidation (POX) gasification. As used herein, the term "steam reforming" refers to the conversion of a carbon-containing feed into syngas via reaction with water. The steam reforming can be steam methane reforming and the carbon-containing feed can be a methane-containing stream, such as natural gas. As used herein, the term "partial oxidation (POX) gasification" or "POX gasification" refers to high temperature conversion of a carbon-containing feed into syngas, (carbon monoxide, hydrogen, and carbon dioxide), where the conversion is carried out in the presence of a less than stoichiometric amount of oxygen. The carbon containing-feed to POX gasification can include solids, liquids, and/or gases.

As shown in FIG. 1, at least a portion of the r-pygas stream 118 and/or r-pyoil stream 120 can be introduced into the cracking step/facility 30. The cracking step/facility 30 includes a cracker furnace 32 for thermally decomposing the hydrocarbon feed by cracking, and a separation zone 34 for separating the cracked effluent from the furnace 32 into one or more recycled content products. A hydrocarbon feed stream 123 introduced into the cracker furnace 32 can include predominantly C2 to C5 hydrocarbons or predominantly C5 to C22 hydrocarbons, and may comprise recycled content or may not.

Additionally, as shown in FIG. 1, at least a portion of the r-pyoil 120 can also be introduced into the inlet of the furnace 32 alone or in combination with the hydrocarbon feed stream 123. In some cases, pyoil 121 from another pyrolysis facility (not shown) may be introduced into the cracker furnace 32. The additional pyoil 121 may include recycled content or it may not. At least a portion of the r-pyoil 120 may also be used as a solvent in the liquification zone/step 40, as shown in FIG. 1. Additionally, or alternatively, at least a portion of the r-pyoil 120 may be removed from the facility for further storage, transport, and/or sale.

In some embodiments, at least a portion of the r-pygas 118 may be introduced into the cracking step/facility 30 in a location downstream of the cracker furnace 32. In particular, at least a portion of the r-pygas 118 may be introduced into the separation facility 34 of the cracking step/facility 30 and may be combined with the stream of furnace effluent 122 withdrawn from the cracker furnace 32. The cracking step/facility 30 may also include a quench step/zone after the furnace 32 and a compression step/zone prior to the separation zone 34 (not shown). Typically, the r-pygas 118 can be combined with the compressed cracked stream introduced into the separation zone 34, although other locations are also possible.

The separation zone 34 of the cracking step/facility 30 separates the cracked stream 122 into two or more recycled content products, such as, for example, at least one recycled content paraffin (r-paraffin) 126 and at least one recycled content olefin (r-olefin) 124. Examples of suitable r-paraffins include r-methane, r-ethane, r-propane, and r-butane, while examples of suitable r-olefins include r-ethylene, r-propylene, and r-butylene. Other recycled content products may also be formed such as recycled content dienes and recycled content C5 and heavier streams. Each of the product streams can have a recycled content of at least 50, at least 75, at least 90, or at least 95 percent.

As also shown in FIG. 1, at least a portion of the r-pyoil 120 may be introduced into a fluidized catalytic cracker (FCC) step/facility 60. In some embodiments, the r-pyoil 120 may be combined with a non-recycled content FCC feed, including, for example, atmospheric residual oil, vacuum residual oil, or any other petroleum stream. The feed introduced into the FCC step/facility 60 may be catalytically cracked in a bed of fluidized catalyst at temperatures between about 800 and 1150° C., 850 and 1100° C., or 900 and 1050° C. During cracking, larger chain carbon molecules can be cracked to form smaller chain molecules and coke (carbon), which deposits itself onto the surface of the solid catalyst. Suitable catalysts include, but are not limited to, zeolite Y, ZSM-5, and combinations thereof.

Upon exiting the FCC reactor, catalyst can be removed from the hydrocarbon stream, which can be cooled and separated into various product streams according to boiling point range in the FCC main fractionator. The catalyst can then be regenerated in an FCC regenerator by contact with air and heat to remove coke and other compounds, and the regenerated catalyst can be returned to the reactor. The main fractionator may be operated to provide several different hydrocarbon streams or products by boiling point, such as gasoline, and diesel, with the lightest fraction (C5 and lighter) being sent to a separate downstream FCC gas plant. In the gas plant, various streams such as, for example, those comprising predominantly ethane and lighter components, predominantly C2, C3, and/or C4 olefins and/or predominantly C3 to C5 paraffins (LPG), may be separated from one another in a series of fractionation columns. When the feed stream to the FCC unit comprises r-pyoil, these product streams may also include recycle content and may therefore comprise, for example, recycled content gasoline (r-gasoline) 128 and recycled content diesel (r-diesel) 130.

In some embodiments as shown in FIG. 1, all or a portion of the C5 and lighter gas stream 132 from the FCC step/facility can be combined with the stream of cracked effluent from the cracker furnace 32. The resulting combined stream can be separated in separation zone 34 of the cracking step/facility. In some cases, the cracker separation zone 34 can be used in place of an FCC gas plant, while, in other cases, both may be used in parallel.

Referring back to the PET-enriched stream 114 withdrawn from the MPW separating step/facility 10, at least a portion of the PET-enriched stream 114 may be further processed in an optional solvolysis step/facility 50, when present. During solvolysis, the PET and other polyester materials dissolved in a solvent can be chemically decomposed to form ethylene glycol (EG) and dimethyl terephthalate (DMT), both of which can be used as chemical intermediates for forming further recycled content products. When the PET processed in the solvolysis facility is waste PET, the EG and DMT withdrawn from the process can comprise recycled content EG (r-EG) and recycled content DMT (r-DMT) 134.

In some cases, the solvolysis can include alcoholysis (like methanolysis), glycolysis, hydrolysis, or combinations thereof. As shown in FIG. 1, a stream of co-products formed during solvolysis may also be withdrawn from the solvolysis step/facility 50 and can be used as a solvent for waste plastic in the liquification zone/step 40. As also shown in FIG. 1, at least a portion of the PET-enriched stream 114 may be removed from the facility for further storage, transport, and/or sale.

Figure 2A:
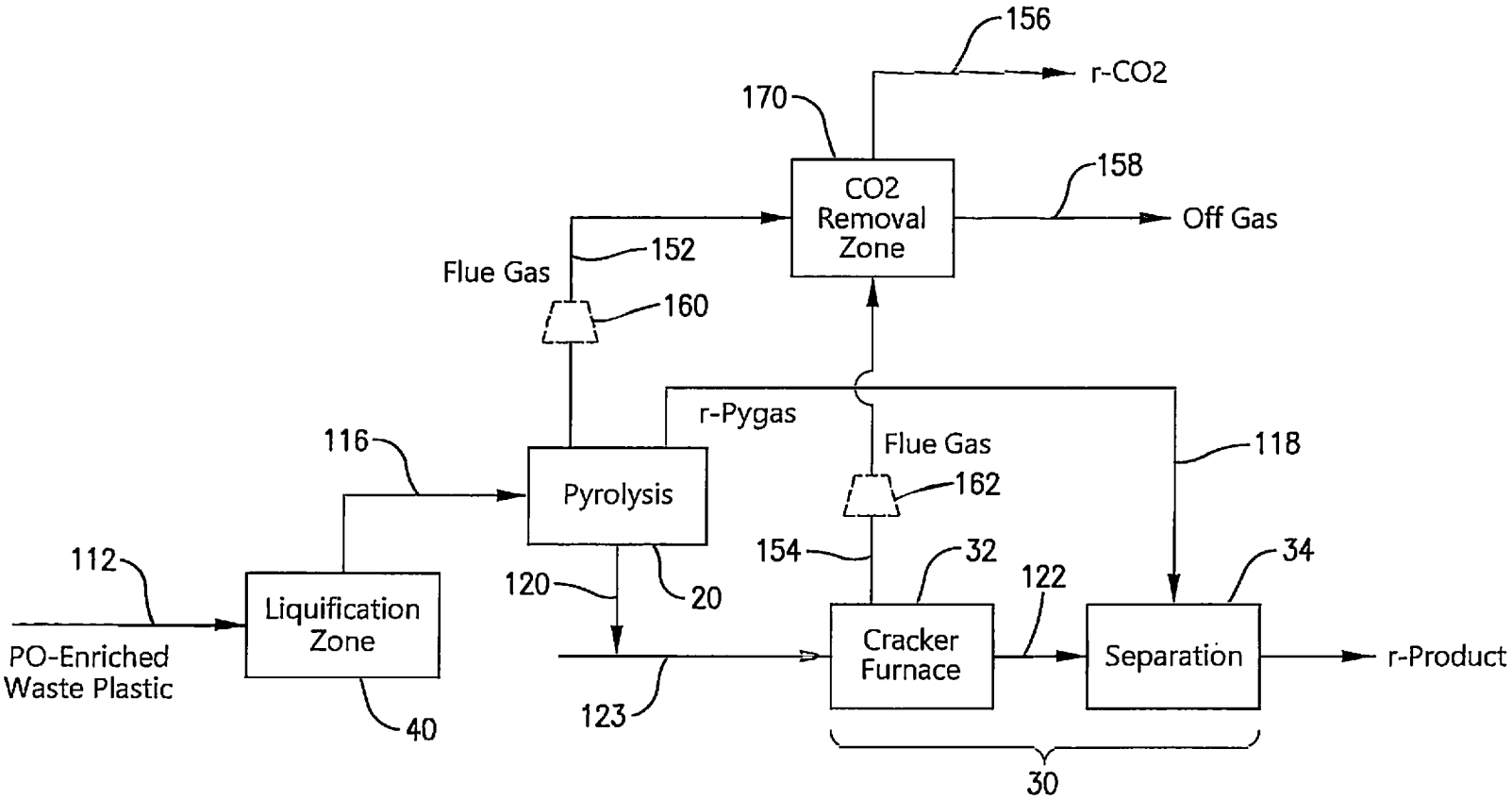
FIG. 2A is a block flow diagram illustrating the main steps of a portion of the facility shown in FIG. 1 configured to capture carbon dioxide (CO2) from one or more process effluent streams of the process/facility to reduce CO2 emissions.
Figure 2B:
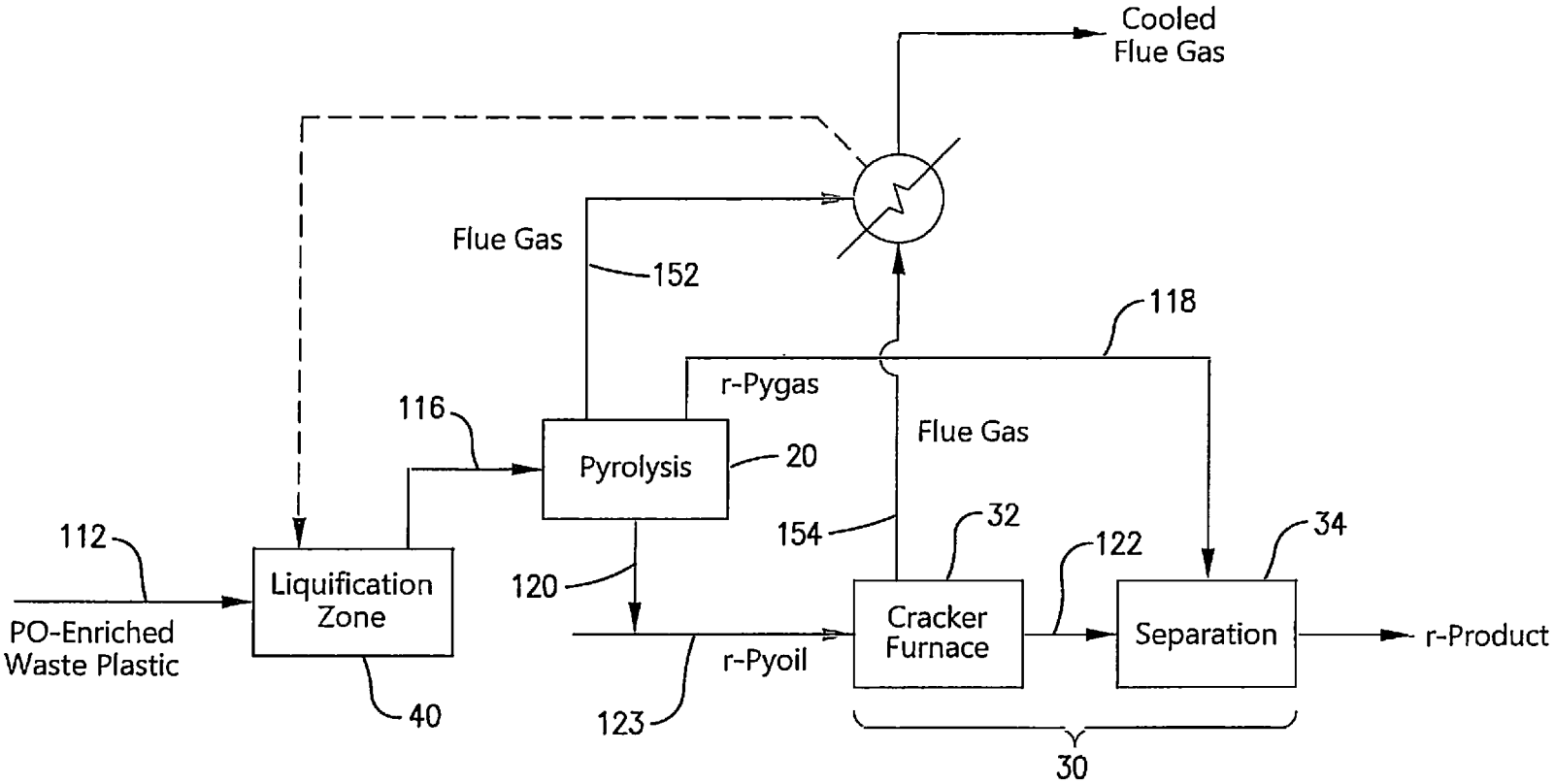
FIG. 2B is a block flow diagram illustrating the main steps of a portion of the facility shown in FIG. 1 configured to recover energy from one or more process effluent streams and reuse the energy in other areas of the process/facility to improve energy efficiency.
Figure 2C:
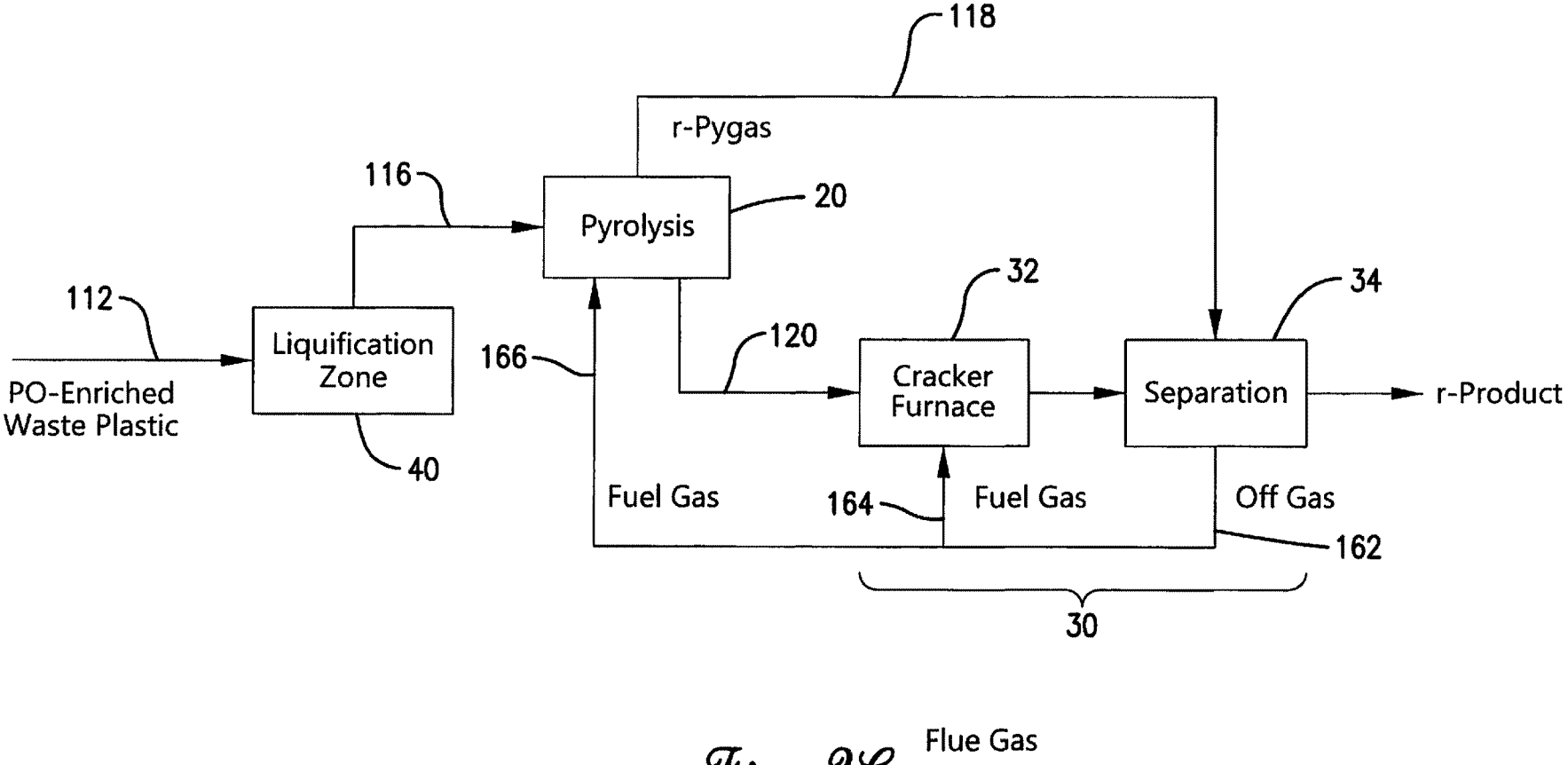
FIG. 2C is a block flow diagram illustrating the main steps of a portion of the facility shown in FIG. 1 configured to utilize process streams recovered from one area of the facility as fuel gas in another in order to improve energy efficiency and/or reduce CO2 emissions.

Turning now to FIGS. 2A to 2C, several embodiments of integrated steps/facilities within the chemical recycling facility shown in FIG. 1 are provided. Each of these embodiments enhance energy efficiency and/or reduce carbon emissions. Referring first to FIG. 2A, an integrated liquification step/zone 40, a pyrolysis step/facility 20, and cracking step/facility 30 are shown that are configured to minimize carbon emissions. In particular, as shown in FIG. 2A, a stream of flue gas 152 from at least one furnace in the pyrolysis step/facility and/or a stream of flue gas 154 from the cracking furnace 32 can be introduced into a CO2 removal step/zone 170, wherein at least a portion of the carbon dioxide can be captured from the flue gas before it exits the processing facility. One or both of the flue gas streams 152, 154 may optionally be compressed in a compressor 160, 162 as shown in FIG. 2A. In some embodiments, the CO2 removal step/zone 170 can capture at least 50, at least 60, at least 70, at least 75, at least 80, at least 85, at least 90, at least 95, or at least 99 mole percent of the total amount of CO2 in one or both of the flue gas streams 152, 154.

The CO2 removal step/zone 70 can include any suitable carbon dioxide capturing process/apparatus. For example, in some embodiments, the CO2 removal step/zone 170 can include an absorber/stripper system, a solid CO2 absorbent, a membrane separator, or even a CO2 freezing process/apparatus. The CO2-depleted off gas stream 158 removed from the CO2 removal step/zone 170 can comprise less than 50, less than 40, less than 30, less than 20, less than 15, less than 10, less than 5, less than 2, or less than 1 mole percent CO2, while the CO2-enriched stream 156 can include at least 75, at least 90, at least 95, or at least 99 mole percent CO2. The off gas 158 can be removed from the facility, while the stream of CO2 156 may be used in subsequent chemical processing steps. In some embodiments, the CO2 in the CO2-enriched stream 156 may comprise recycled content CO2 (r-CO2) and may be used as a feedstock in producing additional recycled content chemicals and intermediates.

When the CO2 removal step/zone 170 includes an absorber/stripper system, it may include at least one absorber tower for contacting the incoming gas with an absorbent solvent to capture the carbon dioxide and a regeneration tower for removing the captured carbon dioxide from and regenerating the solvent. Examples of suitable types of absorbent solvent include, but are not limited to, amines such as diethanolamine (DEA), monoethanolamine (MEA), methyldiethanolamine (MDEA), diisopropanolamine (DIPA), diglycolamine (DGA), piperazine, sodium hydroxide, potassium hydroxide, sodium carbonate, sodium bicarbonate, potassium carbonate, potassium decarbonate, methanol, SELEXOL®, glycol ether, and combinations thereof.

When the CO2 removal step/zone 170 includes a solid CO2 absorbent, it may include at least one vessel through which the flue gas passes as it contacts the solid absorbent. Examples of suitable types of solid absorbents can include, but are not limited to, metal oxides such as calcium oxide and aluminum oxide, metal hydroxides, molecular sieves, zeolites, activated carbon, and combinations thereof.

Although shown as a single zone, the CO2 removal step/zone 170 may include two or more separate units through which the flue gas 152 from the pyrolysis step/facility 20 and the flue gas 154 from the cracking step/facility 30 may separately pass. Alternatively, each of the flue gas streams 152, 154 may be combined prior to or within the CO2 removal step/zone 170 and may be processed in the same equipment.

Turning now to FIG. 2B, one embodiment of an integrated liquification step/zone 40, a pyrolysis step/facility 20, and cracking step/facility 30 are shown that are configured to enhance energy efficiency. In particular, as shown in FIG. 2B, a stream of flue gas 152 from the pyrolysis step/facility and/or a stream of flue gas 154 from the cracking step/facility can be passed through a heat exchange zone 130, wherein at least a portion of the heat from the flue gas streams 152, 154 can be recovered. At least a portion of the recovered heat can then be used in the liquification step/zone 40 to facilitate liquifying the waste plastic, as indicated by the dashed line in FIG. 2B.

The heat transfer from the flue gas streams 152, 154 can take place in any suitable type of exchanger or exchangers and may directly heat a process stream associated with the liquification step/zone 40 or it may heat a stream of heat transfer medium which may then be used to heat a process stream associated with the liquification step/zone 40. For example, in some cases, the recovered heat can be used to melt the plastic, while in other cases, it can be used to warm a solvent used to dissolve the plastic. In such embodiments, increased energy efficiency by recovering and utilizing waste heat from the flue gas streams 152, 154 helps reduce the carbon footprint of the integrated facility by reducing the amount of non-recycled carbon fuels (e.g., natural gas) needed to maintain the temperature of the liquification step/zone 40.

Turning now to FIG. 2C, one embodiment of an integrated liquification step/zone 40, a pyrolysis step/facility 20, and cracking step/facility 30 are shown that are configured to both enhance energy efficiency and reduce carbon emissions. In particular, as shown in FIG. 2C, at least one off-gas stream 162 withdrawn from the separation zone 34 of the cracking step/facility 30 can be used as fuel gas in one or both of the cracking furnace 32 or at least one furnace in the pyrolysis step/facility 20 (e.g., in a pyrolysis furnace used as a reactor and/or in a furnace used to warm heat transfer medium used to provide thermal energy to the pyrolysis reactor).

The off-gas stream 162 withdrawn from the separation zone 34 can be a vapor-phase stream comprising predominantly methane and/or hydrogen. In some cases, the stream 162 can include at least 50, at least 75, at least 90, at least 95, or at least 99 percent methane and/or hydrogen. The methane may be recycled content methane (r-methane)

and/or the hydrogen may be recycled content hydrogen (r-H2). Alternatively, or in addition, the off gas stream 162 may not have recycled content. Such a configuration can eliminate the need for additional non-recycled content fuel gas, and can also provide energy integration, which may increase efficiency.

Although shown in separate Figures, a single chemical recycling facility can include one or more of the integrated steps/zones illustrated in FIGS. 2A-2C. For example, a chemical recycling facility may include both a CO2 removal zone as shown in FIG. 2A and a heat exchange zone as shown in FIG. 2B. In some cases, a chemical recycling facility may include an off-gas fuel source as shown in FIG. 2C, as well as a CO2 removal zone (FIG. 2A) or a heat exchange zone (FIG. 2B). In some cases, a single facility may include a CO2 removal zone (FIG. 2A), a heat exchange zone (FIG. 2B), and may also utilize an off-gas fuel source (FIG. 2C).

In one embodiment or in combination with one or more embodiments disclosed herein, the pyrolysis reaction performed in the pyrolysis reactor can be carried out at a temperature of less than 700, less than 650, or less than 600° C. and at least 300, at least 350, or at least 400° C. The feed to the pyrolysis reactor can comprise, consists essentially of, or consists of waste plastic. The feed stream, and/or the waste plastic component of the feed stream, can have a number average molecular weight (Mn) of at least 3000, at least 4000, at least 5000, or at least 6000 g/mole. If the feed to the pyrolysis reactor contains a mixture of components, the Mn of the pyrolysis feed is the weighted average Mn of all feed components, based on the mass of the individual feed components. The waste plastic in the feed to the pyrolysis reactor can include post-consumer waste plastic, post-industrial waste plastic, or combinations thereof. In certain embodiments, the feed to the pyrolysis reactor comprises less than 5, less than 2, less than 1, less than 0.5, or about 0.0 weight percent coal and/or biomass (e.g., lignocellulosic waste, switchgrass, fats and oils derived from animals, fats and oils derived from plants, etc.), based on the weight of solids in pyrolysis feed or based on the weight of the entire pyrolysis feed. The feed to the pyrolysis reaction can also comprise less than 5, less than 2, less than 1, or less than 0.5, or about 0.0 weight percent of a co-feed stream, including steam, sulfur-containing co-feed streams, and/or non-plastic hydrocarbons (e.g., non-plastic hydrocarbons having less than 50, less than 30, or less than 20 carbon atoms), based on the weight of the entire pyrolysis feed other than water or based on the weight of the entire pyrolysis feed.

Additionally, or alternatively, the pyrolysis reactor may comprise a film reactor, a screw extruder, a tubular reactor, a stirred tank reactor, a riser reactor, a fixed bed reactor, a fluidized bed reactor, a rotary kiln, a vacuum reactor, a microwave reactor, or an autoclave. The reactor may also utilize a feed gas and/or lift gas for facilitating the introduction of the feed into the pyrolysis reactor. The feed gas and/or lift gas can comprise nitrogen and can comprise less than 5, less than 2, less than 1, or less than 0.5, or about 0.0 weight percent of steam and/or sulfur-containing compounds.

In one embodiment or in combination with one or more embodiments disclosed herein, the cracker furnace can be operated at a product outlet temperature (e.g., coil outlet temperature) of at least 700, at least 750, at least 800, or at least 850° C. The feed to the cracker furnace can have a number average molecular weight (Mn) of less than 3000, less than 2000, less than 1000, or less than 500 g/mole. If the feed to the cracker contains a mixture of components, the Mn of the cracker feed is the weighted average Mn of all feed components, based on the mass of the individual feed components. The feed to the cracker furnace can comprise less than 5, less than 2, less than 1, less than 0.5, or 0.0 weight percent of coal, biomass, and/or solids. In certain embodiments, a co-feed stream, such as steam or a sulfur-containing stream (for metal passivation) can be introduced into the cracker furnace. The cracker furnace can include both convection and radiant sections and can have a tubular reaction zone (e.g., coils in one or both of the convection and radiant sections). Typically, the residence time of the streams passing through the reaction zone (from the convection section inlet to the radiant section outlet) can be less than 20 seconds, less than 10 seconds, less than 5 seconds, or less than 2 seconds.

When a numerical sequence is indicated, it is to be understood that each number is modified the same as the first number or last number in the numerical sequence or in the sentence, e.g., each number is "at least," or "up to" or "not more than" as the case may be; and each number is in an "or" relationship. For example, "at least 10, 20, 30, 40, 50, 75 wt. % . . . " means the same as "at least 10 wt. %, or at least 20 wt. %, or at least 30 wt. %, or at least 40 wt. %, or at least 50 wt. %, or at least 75 wt. %," etc.; and "not more than 90 wt. %, 85, 70, 60 . . . " means the same as "not more than 90 wt. %, or not more than 85 wt. %, or not more than 70 wt. % . . . " etc.; and "at least 1%, 2%, 3%, 4%, 5%, 6%, 7%, 8%, 9% or 10% by weight . . . " means the same as "at least 1 wt. %, or at least 2 wt. %, or at least 3 wt. % . . . " etc.; and "at least 5, 10, 15, 20 and/or not more than 99, 95, 90 weight percent" means the same as "at least 5 wt. %, or at least 10 wt. %, or at least 15 wt. % or at least 20 wt. % and/or not more than 99 wt. %, or not more than 95 wt. %, or not more than 90 weight percent . . . " etc.

Definitions

It should be understood that the following is not intended to be an exclusive list of defined terms. Other definitions may be provided in the foregoing description, such as, for example, when accompanying the use of a defined term in context.

As used herein, the terms "a," "an," and "the" mean one or more.

As used herein, the term "and/or," when used in a list of two or more items, means that any one of the listed items can be employed by itself or any combination of two or more of the listed items can be employed. For example, if a composition is described as containing components A, B, and/or C, the composition can contain A alone; B alone; C alone; A and B in combination; A and C in combination, B and C in combination; or A, B, and C in combination.

As used herein, the phrase "at least a portion" includes at least a portion and up to and including the entire amount or time period.

As used herein, the term "chemical recycling" refers to a waste plastic recycling process that includes a step of chemically converting waste plastic polymers into lower molecular weight polymers, oligomers, monomers, and/or non-polymeric molecules (e.g., hydrogen, carbon monoxide, methane, ethane, propane, ethylene, and propylene) that are useful by themselves and/or are useful as feedstocks to another chemical production process(es).

As used herein, the term "co-located" refers to the characteristic of at least two objects being situated on a common physical site, and/or within one mile of each other.

As used herein, the term "commercial scale facility" refers to a facility having an average annual feed rate of at least 500 pounds per hour, averaged over one year.

As used herein, the terms "comprising," "comprises," and "comprise" are open-ended transition terms used to transition from a subject recited before the term to one or more elements recited after the term, where the element or elements listed after the transition term are not necessarily the only elements that make up the subject.

As used herein, the term "cracking" refers to breaking down complex organic molecules into simpler molecules by the breaking of carbon-carbon bonds.

As used herein, the terms "including," "include," and "included" have the same open-ended meaning as "comprising," "comprises," and "comprise" provided above.

As used herein, the term "located remotely" refers to a distance of greater than 1, greater than 5, greater than 10, greater than 50, greater than 100, greater than 500, greater than 1000, or greater than 10,000 miles between two facilities, sites, or reactors.

As used herein, the term "molecular reforming" refers to conversion of a carbon-containing feed into syngas (CO, CO2, and H2). Molecular reforming encompasses both steam reforming and partial oxidation (POX) gasification.

As used herein, the term "partial oxidation (POX) gasification" or "POX gasification" refers to high temperature conversion of a carbon-containing feed into syngas, (carbon monoxide, hydrogen, and carbon dioxide), where the conversion is carried out in the presence of a less than stoichiometric amount of oxygen.

As used herein, the term "predominantly" means more than 50 percent by weight. For example, a predominantly propane stream, composition, feedstock, or product is a stream, composition, feedstock, or product that contains more than 50 weight percent propane.

As used herein, the term "pyrolysis" refers to thermal decomposition of one or more organic materials at elevated temperatures in an inert (i.e., substantially oxygen free) atmosphere.

As used herein, the terms "pyrolysis gas" and "pygas" refer to a composition obtained from pyrolysis that is gaseous at 25° C.

As used herein, the terms "pyrolysis oil" or "pyoil" refers to a composition obtained from pyrolysis that is liquid at 25° C. and 1 atm.

As used herein, the term "pyrolysis residue" refers to a composition obtained from pyrolysis that is not pyrolysis gas or pyrolysis oil and that comprises predominantly pyrolysis char and pyrolysis heavy waxes.

As used herein, the term "pyrolysis vapor" refers to the overhead or vapor-phase stream withdrawn from the separator in a pyrolysis facility and including r-pygas and r-pyoil.

As used herein, the term "recycled content" refers to being or comprising a composition that is directly and/or indirectly derived from recycled material.

As used herein, the term "waste material" refers to used, scrap, and/or discarded material.

As used herein, the terms "waste plastic" and "plastic waste" refer to used, scrap, and/or discarded plastic materials.

Additional Claim Supporting Description-First Embodiment

In a first embodiment of the present technology there is provided a process for making a recycled content hydrocarbon product (r-product), the process comprising: (a) liquefying a plastic in a liquification zone to provide a liquified waste plastic; (b) pyrolyzing at least a portion of the liquified waste plastic in a pyrolysis facility to produce a recycled content pyrolysis vapor (r-pyrolysis vapor); (c) introducing at least a portion of the r-pyrolysis vapor into a separation zone downstream of a cracker furnace in a cracking facility; and (d) separating at least a portion of the r-pyrolysis vapor in the separation zone to provide the recycled content hydrocarbon product, wherein at least one of following steps (i) through (iii) is also performed—(i) passing at least a portion of a flue gas from the pyrolysis furnace and/or the cracker furnace through a carbon dioxide removal zone to capture at least a portion of the carbon dioxide; (ii) recovering energy from a flue gas from the pyrolysis furnace and/or the cracker furnace and using at least a portion of the recovered energy to perform the liquefying of step (a); and (iii) recovering an off-gas stream from the separation zone in the cracking facility and using at least a portion of the off-gas stream as fuel in the pyrolysis and/or cracker furnace.

The first embodiment described in the preceding paragraph can also include one or more of the additional aspects/features listed in the following bullet pointed paragraphs. Each of the below additional features of the first embodiment can be standalone features or can be combined with one or more of the other additional features to the extent consistent. Additionally, the following bullet pointed paragraphs can be viewed as dependent claim features having levels of dependency indicated by the degree of indention in the bulleted list (i.e., a feature indented further than the feature(s) listed above it is considered dependent on the feature(s) listed above it).

- wherein the r-pyrolysis vapor comprises recycled content pyrolysis gas (r-pygas) and recycled content pyrolysis oil (r-pyoil).
  - further comprising, introducing at least a portion of the r-pygas into the cracking facility at a location downstream of the cracker furnace, wherein the introducing of step (d) includes separating at least a portion of the r-pygas introduced into the cracking facility.
  - further comprising, cracking at least a portion of the r-pyoil in the cracker furnace to provide a recycled content cracked stream (r-cracked stream), wherein the separating of step (d) includes separating at least a portion of the r-cracked stream.
- wherein the process further comprises step (i) passing at least a portion of a flue gas from the pyrolysis furnace and/or the cracker furnace through a carbon dioxide removal zone to capture at least a portion of the carbon dioxide.
  - wherein the carbon dioxide comprises recycled content carbon dioxide.
  - wherein the carbon dioxide removal zone recovers at least 75, 90, 95, or 99 mole percent of the CO2 in the flue gas.
  - wherein a stream of CO2-depleted off gas is withdrawn from the carbon dioxide removal zone, and the CO2-depleted off gas comprises not more than 50, 40, 30, 20, 15, 10, 5, 2, or 1 mole percent CO2.
  - further comprising compressing at least a portion of the flue gas from the pyrolysis furnace and/or the cracker furnace and introducing the compressed flue gas into the carbon dioxide removal zone.
  - wherein the carbon dioxide removal zone comprises an absorber/stripper system.
    - wherein the absorber/stripper system includes a liquid absorbent for removing the carbon dioxide from the flue gas, and wherein the liquid absorbent is selected from the group of MDEA, MEA, DEA, DIPA, DGA, piperazine, sodium hydroxide, potassium hydroxide, sodium carbonate/bicarbonate, potassium carbonate/bicarbonate, SELEXOL®, methanol, glycol ether, and combinations thereof.

wherein the carbon dioxide removal zone comprises a solid CO2 absorbent.

wherein the solid CO2 absorbent includes oxides, hydroxides, mole sieve, calcium oxide, activated carbon, and combinations thereof.

wherein the carbon dioxide removal zone comprises a membrane separator.

wherein the passing includes passing at least a portion of the flue gas from the pyrolysis furnace through an absorber/stripper system.

wherein the passing includes passing at least a portion of the flue gas from the cracker furnace through a different absorber/stripper system.

wherein the passing includes passing at least a portion of the flue gas from the cracker furnace through the same absorber/stripper system.

wherein the absorber/stripper system includes at least one absorber column for contacting the flue gas with an absorbent to remove carbon dioxide and a stripper column for removing carbon dioxide from the absorbent.

wherein the absorbent is selected from the group consisting of MDEA, MEA, DEA, DIPA, DGA, piperazine, sodium hydroxide, potassium hydroxide, sodium carbonate/bicarbonate, potassium carbonate/bicarbonate, SELEXOL®, methanol, glycol ether, and combinations thereof.

wherein the process further comprises step (ii) recovering energy from a flue gas from the pyrolysis furnace and/or the cracker furnace and using at least a portion of the recovered energy to perform the liquefying of step (a).

wherein the liquefying of step (a) includes melting the plastic to form a molten plastic stream.

wherein the liquefying of step (a) includes combining the plastic with a solvent to form a dissolved plastic.

wherein the recovering of step (ii) includes warming a heat transfer medium via indirect heat exchange with the flue gas and using the warmed heat transfer medium to warm at least one process stream associated with the liquefying of step (a).

wherein the process stream is a solvent added to the plastic.

wherein the process stream comprises the plastic.

wherein the process further comprises step (iii) recovering an off-gas stream from the separation zone in the cracking facility and using at least a portion of the off-gas stream as fuel in the pyrolysis and/or cracker furnace.

wherein the off-gas stream originates from the separation zone of the cracker facility.

wherein the off-gas stream comprises at least 50, 75, 90, 95 mole percent hydrogen.

wherein the off-gas stream comprises at least 50, 75, 90, 95 mole percent methane.

wherein the off-gas stream comprises recycled content off-gas (r-off gas).

wherein the off-gas stream is used as fuel in both the pyrolysis and cracker furnaces.

prior to the liquefying of step (a), separating a stream of mixed plastic waste (MPW) into a polyolefin-enriched (PO-enriched) plastic and a polyethylene terephthalate-enriched (PET) enriched plastic in a MPW separator.

wherein the MPW separator is a density separator.

wherein the separating includes removing waste products including cardboard, mold, rocks, sand, glass, and combinations thereof.

prior to the separating, reducing the size of the MPW and separating the size reduced MPW.

wherein the MPW originates from a municipal recycling facility (MRF).

wherein the MRF is co-located with the MRF.

wherein the MPW separator is co-located with the pyrolysis facility.

further comprising, selling, transporting, and/or storing at least a portion of the PET-enriched plastic.

further comprising, subjecting at least a portion of the PET-enriched plastic to solvolysis in a solvolysis facility to produce recycled content dimethyl terephthalate (r-DMT).

wherein the solvolysis is methanolysis.

wherein the solvolysis produces one or more co-products, and further comprising introducing at least a portion of the co-products into the liquification zone.

wherein the solvolysis facility is co-located with at least one of the pyrolysis facility and the cracking facility.

wherein the plastic liquefied in step (a) comprises the PO-enriched plastic from the MPW separator.

wherein the liquifying of step (a) includes melting the plastic.

further comprising step (ii) recovering energy from a flue gas from the pyrolysis furnace and/or the cracker furnace and using at least a portion of the recovered energy to perform the liquefying of step (a)

wherein the recovering is performed with at least one indirect heat exchanger.

wherein the recovering is performed with the flue gas from both the pyrolysis furnace and cracker furnace in separate heat exchangers.

wherein the liquifying of step (a) includes dissolving the plastic in at least one solvent.

wherein the solvent comprises methanol.

wherein the solvent comprises a co-product stream from another zone within the chemical recycling facility.

wherein the solvent comprises a recycled content pyrolysis oil recovered from the r-pyrolysis vapor.

further requiring removing at least a portion of one or more impurities from the plastic before or after liquification.

wherein the impurities include halogens.

further comprising separating at least a portion of the r-pyrolysis vapor into a recycled content pyrolysis gas (r-pygas) and a recycled content pyrolysis oil (r-pyoil), wherein at least a portion of the r-pygas is introduced into the separation zone downstream of the cracker furnace.

wherein the r-pyrolysis vapor includes at least 50, 60, 70, 80, 90, 95 volume percent of r-pygas.

wherein the r-pyrolysis vapor includes at least 10, 20, 30, 40, 50, 60, 70, 80, or 90 weight percent of r-pygas.

wherein the r-pyrolysis vapor includes less than 50, 40, 30, 20, 10, 5 volume percent of r-pyrolysis oil.

wherein the r-pyrolysis vapor includes less than 90, 80, 70, 60, 50, 40, 30, 20, or 10 weight percent of r-pyrolysis oil.

further comprising cracking at least a portion of the r-pyoil in the cracker furnace to provide a cracked effluent.

further comprising cracking at least a portion of the r-pyoil in a fluidized catalytic cracker (FCC) to provide a recycled content cracked gas (r-cracked gas).

further comprising separating at least a portion of the r-cracked gas in the separation zone downstream of the cracker furnace to provide at least one recycled content hydrocarbon product (r-product).

further comprising separating at least a portion of the cracked r-pyoil to form recycled content gasoline (r-gasoline) and recycled content diesel (r-diesel).

further comprising selling, transporting, and/or storing at least a portion of the r-pyoil.

wherein the pyrolysis facility and the cracker facility are co-located.

wherein the pyrolysis facility is remotely located from the cracker facility.

Additional Claim Supporting Description—Second Embodiment

In a second embodiment of the present technology there is provided a process for making a recycled content hydrocarbon product (r-product), the process comprising: (a) separating mixed waste plastic in a mixed plastic waste (MPW) separator into a polyolefin-enriched (PO-enriched) fraction and a polyolefin-depleted (PO-depleted) fraction; (b) liquefying at least a portion of the PO-enriched fraction in a liquification zone to provide a liquified waste plastic; (c) pyrolyzing at least a portion of the liquified waste plastic in a pyrolysis furnace of a pyrolysis facility to produce a recycled content pyrolysis vapor (r-pyrolysis vapor); (d) introducing at least a portion of the r-pyrolysis vapor into a separation zone downstream of a cracker furnace in a cracking facility; and (e) separating at least a portion of the r-pyrolysis vapor in the separation zone to provide the recycled content hydrocarbon product, wherein at least one of following steps (i) through (iii) is also performed-(i) passing at least a portion of a flue gas from the pyrolysis furnace and/or the cracker furnace through a carbon dioxide removal zone to recover at least a portion of the carbon dioxide; (ii) recovering thermal energy from a flue gas from the pyrolysis furnace and/or the cracker furnace and transferring at least a portion of said thermal energy to said liquification zone; and (iii) recovering an off-gas stream from the separation zone in the cracking facility and combusting at least a portion of the off-gas stream as fuel in the pyrolysis and/or cracker furnace.

The second embodiment described in the preceding paragraph can also include one or more of the additional aspects/features listed in the following bullet pointed paragraphs. Each of the below additional features of the second embodiment can be standalone features or can be combined with one or more of the other additional features to the extent consistent. Additionally, the following bullet pointed paragraphs can be viewed as dependent claim features having levels of dependency indicated by the degree of indention in the bulleted list (i.e., a feature indented further than the feature(s) listed above it is considered dependent on the feature(s) listed above it).

wherein the PO-depleted fraction is a polyethylene terephthalate-enriched (PET) enriched fraction.

further comprising, subjecting at least a portion of the PET-enriched plastic to solvolysis in a solvolysis facility to produce recycled content dimethyl terephthalate (r-DMT) and wherein the solvolysis produces one or more co-products, and further comprising introducing at least a portion of the co-products into the liquification zone, and wherein the solvolysis facility is co-located with the pyrolysis facility and the cracking facility.

wherein the MPW separator, the pyrolysis facility and the cracking facility are co-located.

wherein the r-pyrolysis vapor comprises recycled content pyrolysis gas (r-pygas) and recycled content pyrolysis oil (r-pyoil).

further comprising, introducing at least a portion of the r-pygas into the cracking facility at a location downstream of the cracker furnace, wherein the introducing of step (d) includes separating at least a portion of the r-pygas introduced into the cracking facility.

further comprising, cracking at least a portion of the r-pyoil in the cracker furnace to provide a recycled content cracked stream (r-cracked stream), wherein the separating of step (d) includes separating at least a portion of the r-cracked stream.

wherein the process further comprises step (i) passing at least a portion of a flue gas from the pyrolysis furnace and/or the cracker furnace through a carbon dioxide removal zone to capture at least a portion of the carbon dioxide.

wherein the carbon dioxide comprises recycled content carbon dioxide.

wherein the carbon dioxide removal zone recovers at least 75, 90, 95, or 99 mole percent of the CO2 in the flue gas.

wherein a stream of CO2-depleted off gas is withdrawn from the carbon dioxide removal zone, and the CO2-depleted off gas comprises not more than 50, 40, 30, 20, 15, 10, 5, 2, or 1 mole percent CO2.

further comprising compressing at least a portion of the flue gas from the pyrolysis furnace and/or the cracker furnace and introducing the compressed flue gas into the carbon dioxide removal zone.

wherein the carbon dioxide removal zone comprises an absorber/stripper system.

wherein the absorber/stripper system includes a liquid absorbent for removing the carbon dioxide from the flue gas, and wherein the liquid absorbent is selected from the group of MDEA, MEA, DEA, DIPA, DGA, piperazine, sodium hydroxide, potassium hydroxide, sodium carbonate/bicarbonate, potassium carbonate/bicarbonate, SELEXOL®, methanol, glycol ether, and combinations thereof.

wherein the carbon dioxide removal zone comprises a solid CO2 absorbent.

wherein the solid CO2 absorbent includes oxides, hydroxides, mole sieve, calcium oxide, activated carbon, and combinations thereof.

wherein the carbon dioxide removal zone comprises a membrane separator.

wherein the passing includes passing at least a portion of the flue gas from the pyrolysis furnace through an absorber/stripper system.

wherein the passing includes passing at least a portion of the flue gas from the cracker furnace through a different absorber/stripper system.

wherein the passing includes passing at least a portion of the flue gas from the cracker furnace through the same absorber/stripper system.

wherein the absorber/stripper system includes at least one absorber column for contacting the flue gas with an absorbent to remove carbon dioxide and a stripper column for removing carbon dioxide from the absorbent.

wherein the absorbent is selected from the group consisting of MDEA, MEA, DEA, DIPA, DGA, piperazine, sodium hydroxide, potassium hydroxide, sodium carbonate/bicarbonate, potassium carbonate/bicarbonate, SELEXOL®, methanol, glycol ether, and combinations thereof.

wherein the process further comprises step (ii) recovering energy from a flue gas from the pyrolysis furnace and/or the cracker furnace and using at least a portion of the recovered energy to perform the liquefying of step (a).

wherein the liquefying of step (a) includes melting the plastic to form a molten plastic stream.

wherein the liquefying of step (a) includes combining the plastic with a solvent to form a dissolved plastic.

wherein the recovering of step (ii) includes warming a heat transfer medium via indirect heat exchange with the flue gas and using the warmed heat transfer medium to warm at least one process stream associated with the liquefying of step (a).

wherein the process stream is a solvent added to the plastic.

wherein the process stream comprises the plastic.

wherein the process further comprises step (iii) recovering an off-gas stream from the separation zone in the cracking facility and using at least a portion of the off-gas stream as fuel in the pyrolysis and/or cracker furnace.

wherein the off-gas stream originates from the separation zone of the cracker facility.

wherein the off-gas stream comprises at least 50, 75, 90, 95 mole percent hydrogen.

wherein the off-gas stream comprises at least 50, 75, 90, 95 mole percent methane.

wherein the off-gas stream comprises recycled content off-gas (r-off gas).

wherein the off-gas stream is used as fuel in both the pyrolysis and cracker furnaces.

prior to the liquefying of step (a), separating a stream of mixed plastic waste (MPW) into a polyolefin-enriched (PO-enriched) plastic and a polyethylene terephthalate-enriched (PET) enriched plastic in a MPW separator.

wherein the MPW separator is a density separator.

wherein the separating includes removing waste products including cardboard, mold, rocks, sand, glass, and combinations thereof.

prior to the separating, reducing the size of the MPW and separating the size reduced MPW.

wherein the MPW originates from a municipal recycling facility (MRF).

wherein the MRF is co-located with the MRF.

wherein the MPW separator is co-located with the pyrolysis facility.

further comprising, selling, transporting, and/or storing at least a portion of the PET-enriched plastic.

further comprising, subjecting at least a portion of the PET-enriched plastic to solvolysis in a solvolysis facility to produce recycled content dimethyl terephthalate (r-DMT).

wherein the solvolysis is methanolysis.

wherein the solvolysis produces one or more co-products, and further comprising introducing at least a portion of the co-products into the liquification zone.

wherein the solvolysis facility is co-located with at least one of the pyrolysis facility and the cracking facility.

wherein the plastic liquefied in step (a) comprises the PO-enriched plastic from the MPW separator.

wherein the liquifying of step (a) includes melting the plastic.

further comprising step (ii) recovering energy from a flue gas from the pyrolysis furnace and/or the cracker furnace and using at least a portion of the recovered energy to perform the liquefying of step (a)

wherein the recovering is performed with at least one indirect heat exchanger.

wherein the recovering is performed with the flue gas from both the pyrolysis furnace and cracker furnace in separate heat exchangers.

wherein the liquifying of step (a) includes dissolving the plastic in at least one solvent.

wherein the solvent comprises methanol.

wherein the solvent comprises a co-product stream from another zone within the chemical recycling facility.

wherein the solvent comprises a recycled content pyrolysis oil recovered from the r-pyrolysis vapor.

further requiring removing at least a portion of one or more impurities from the plastic before or after liquification.

wherein the impurities include halogens.

further comprising separating at least a portion of the r-pyrolysis vapor into a recycled content pyrolysis gas (r-pygas) and a recycled content pyrolysis oil (r-pyoil), wherein at least a portion of the r-pygas is introduced into the separation zone downstream of the cracker furnace.

wherein the r-pyrolysis vapor includes at least 50, 60, 70, 80, 90, 95 volume percent of r-pygas.

wherein the r-pyrolysis vapor includes at least 10, 20, 30, 40, 50, 60, 70, 80, or 90 weight percent of r-pygas.

wherein the r-pyrolysis vapor includes less than 50, 40, 30, 20, 10, 5 volume percent of r-pyrolysis oil.

wherein the r-pyrolysis vapor includes less than 90, 80, 70, 60, 50, 40, 30, 20, or 10 weight percent of r-pyrolysis oil.

further comprising cracking at least a portion of the r-pyoil in the cracker furnace to provide a cracked effluent.

further comprising cracking at least a portion of the r-pyoil in a fluidized catalytic cracker (FCC) to provide a recycled content cracked gas (r-cracked gas).

further comprising separating at least a portion of the r-cracked gas in the separation zone downstream of the cracker furnace to provide at least one recycled content hydrocarbon product (r-product).

further comprising separating at least a portion of the cracked r-pyoil to form recycled content gasoline (r-gasoline) and recycled content diesel (r-diesel).

further comprising selling, transporting, and/or storing at least a portion of the r-pyoil.

wherein the pyrolysis facility and the cracker facility are co-located.

wherein the pyrolysis facility is remotely located from the cracker facility.

Additional Claim Supporting Description—Third Embodiment

In a third embodiment of the present technology there is provided process for making a recycled content hydrocarbon product (r-product), the process comprising: (a) separating mixed waste plastic into a polyolefin-enriched (PO-enriched) fraction and a polyolefin-depleted (PO-depleted) fraction; (b) liquefying at least a portion of the PO-enriched fraction in a liquification zone to provide a liquified waste plastic; (c) pyrolyzing at least a portion of the liquified waste plastic in a pyrolysis furnace of a pyrolysis facility to produce a recycled content pyrolysis vapor (r-pyrolysis vapor); (d) separating at least a portion of the r-pyrolysis vapor to provide a recycled content pyrolysis gas (r-pygas) and a recycled content pyrolysis oil (r-pyoil); (e) introducing at least a portion of the r-pygas into a separation zone downstream of a cracker furnace in a cracking facility and/or introducing at least a portion of the r-pyoil into an inlet the cracker furnace in the cracking facility; and (f) separating at least a portion of an effluent stream from the cracker furnace in the separation zone to provide the recycled content hydrocarbon product (r-hydrocarbon product), wherein at least one of following steps (i) through (iii) is also performed—(i) passing at least a portion of a flue gas from the pyrolysis furnace and/or the cracker furnace through a carbon dioxide removal zone to recover at least a portion of the carbon dioxide; (ii) recovering thermal energy from a flue gas from the pyrolysis furnace and/or the cracker furnace and transferring at least a portion of said thermal energy to said liquification zone; and (iii) recovering an off-gas stream from the separation zone in the cracking facility and combusting at least a portion of the off-gas stream as fuel in the pyrolysis and/or cracker furnace.

The third embodiment described in the preceding paragraph can also include one or more of the additional aspects/features listed in the following bullet pointed paragraphs. Each of the below additional features of the third embodiment can be standalone features or can be combined with one or more of the other additional features to the extent consistent. Additionally, the following bullet pointed paragraphs can be viewed as dependent claim features having levels of dependency indicated by the degree of indention in the bulleted list (i.e., a feature indented further than the feature(s) listed above it is considered dependent on the feature(s) listed above it).

further comprising introducing at least a portion of the r-pyoil into an inlet of the cracking furnace.

wherein said pyrolyzing of step (c) produces a recycled content pyrolysis residue (r-pyrolysis residue) and further comprising, introducing at least a portion of the r-pyrolysis residue into a molecular reforming facility to produce a recycled content syngas (r-syngas).

wherein the pyrolysis facility and the cracking facility are co-located and commercial-scale facilities.

wherein the r-pyrolysis vapor comprises recycled content pyrolysis gas (r-pygas) and recycled content pyrolysis oil (r-pyoil).

further comprising, introducing at least a portion of the r-pygas into the cracking facility at a location downstream of the cracker furnace, wherein the introducing of step (d) includes separating at least a portion of the r-pygas introduced into the cracking facility.

further comprising, cracking at least a portion of the r-pyoil in the cracker furnace to provide a recycled content cracked stream (r-cracked stream), wherein the separating of step (d) includes separating at least a portion of the r-cracked stream.

wherein the process further comprises step (i) passing at least a portion of a flue gas from the pyrolysis furnace and/or the cracker furnace through a carbon dioxide removal zone to capture at least a portion of the carbon dioxide.

wherein the carbon dioxide comprises recycled content carbon dioxide.

wherein the carbon dioxide removal zone recovers at least 75, 90, 95, or 99 mole percent of the CO2 in the flue gas.

wherein a stream of CO2-depleted off gas is withdrawn from the carbon dioxide removal zone, and the CO2-depleted off gas comprises not more than 50, 40, 30, 20, 15, 10, 5, 2, or 1 mole percent CO2.

further comprising compressing at least a portion of the flue gas from the pyrolysis furnace and/or the cracker furnace and introducing the compressed flue gas into the carbon dioxide removal zone.

wherein the carbon dioxide removal zone comprises an absorber/stripper system.

wherein the absorber/stripper system includes a liquid absorbent for removing the carbon dioxide from the flue gas, and wherein the liquid absorbent is selected from the group of MDEA, MEA, DEA, DIPA, DGA, piperazine, sodium hydroxide, potassium hydroxide, sodium carbonate/bicarbonate, potassium carbonate/bicarbonate, SELEXOL®, methanol, glycol ether, and combinations thereof.

wherein the carbon dioxide removal zone comprises a solid CO2 absorbent.

wherein the solid CO2 absorbent includes oxides, hydroxides, mole sieve, calcium oxide, activated carbon, and combinations thereof.

wherein the carbon dioxide removal zone comprises a membrane separator.

wherein the passing includes passing at least a portion of the flue gas from the pyrolysis furnace through an absorber/stripper system.

wherein the passing includes passing at least a portion of the flue gas from the cracker furnace through a different absorber/stripper system.

wherein the passing includes passing at least a portion of the flue gas from the cracker furnace through the same absorber/stripper system.

wherein the absorber/stripper system includes at least one absorber column for contacting the flue gas with an absorbent to remove carbon dioxide and a stripper column for removing carbon dioxide from the absorbent.

wherein the absorbent is selected from the group consisting of MDEA, MEA, DEA, DIPA, DGA, piperazine, sodium hydroxide, potassium hydroxide, sodium carbonate/bicarbonate, potassium carbonate/bicarbonate, SELEXOL®, methanol, glycol ether, and combinations thereof.

wherein the process further comprises step (ii) recovering energy from a flue gas from the pyrolysis furnace and/or the cracker furnace and using at least a portion of the recovered energy to perform the liquefying of step (a).

wherein the liquefying of step (a) includes melting the plastic to form a molten plastic stream.

wherein the liquefying of step (a) includes combining the plastic with a solvent to form a dissolved plastic.

wherein the recovering of step (ii) includes warming a heat transfer medium via indirect heat exchange with the flue gas and using the warmed heat transfer medium to warm at least one process stream associated with the liquefying of step (a).

wherein the process stream is a solvent added to the plastic.

wherein the process stream comprises the plastic.

wherein the process further comprises step (iii) recovering an off-gas stream from the separation zone in the cracking facility and using at least a portion of the off-gas stream as fuel in the pyrolysis and/or cracker furnace.

wherein the off-gas stream originates from the separation zone of the cracker facility.

wherein the off-gas stream comprises at least 50, 75, 90, 95 mole percent hydrogen.

wherein the off-gas stream comprises at least 50, 75, 90, 95 mole percent methane.

wherein the off-gas stream comprises recycled content off-gas (r-off gas).

wherein the off-gas stream is used as fuel in both the pyrolysis and cracker furnaces.

prior to the liquefying of step (a), separating a stream of mixed plastic waste (MPW) into a polyolefin-enriched (PO-enriched) plastic and a polyethylene terephthalate-enriched (PET) enriched plastic in a MPW separator.

wherein the MPW separator is a density separator.

wherein the separating includes removing waste products including cardboard, mold, rocks, sand, glass, and combinations thereof.

prior to the separating, reducing the size of the MPW and separating the size reduced MPW.

wherein the MPW originates from a municipal recycling facility (MRF).

wherein the MRF is co-located with the MRF.

wherein the MPW separator is co-located with the pyrolysis facility.

further comprising, selling, transporting, and/or storing at least a portion of the PET-enriched plastic.

further comprising, subjecting at least a portion of the PET-enriched plastic to solvolysis in a solvolysis facility to produce recycled content dimethyl terephthalate (r-DMT).

wherein the solvolysis is methanolysis.

wherein the solvolysis produces one or more co-products, and further comprising introducing at least a portion of the co-products into the liquification zone.

wherein the solvolysis facility is co-located with at least one of the pyrolysis facility and the cracking facility.

wherein the plastic liquefied in step (a) comprises the PO-enriched plastic from the MPW separator.

wherein the liquifying of step (a) includes melting the plastic.

further comprising step (ii) recovering energy from a flue gas from the pyrolysis furnace and/or the cracker furnace and using at least a portion of the recovered energy to perform the liquefying of step (a)

wherein the recovering is performed with at least one indirect heat exchanger.

wherein the recovering is performed with the flue gas from both the pyrolysis furnace and cracker furnace in separate heat exchangers.

wherein the liquifying of step (a) includes dissolving the plastic in at least one solvent.

wherein the solvent comprises methanol.

wherein the solvent comprises a co-product stream from another zone within the chemical recycling facility.

wherein the solvent comprises a recycled content pyrolysis oil recovered from the r-pyrolysis vapor.

further requiring removing at least a portion of one or more impurities from the plastic before or after liquification.

wherein the impurities include halogens.

further comprising separating at least a portion of the r-pyrolysis vapor into a recycled content pyrolysis gas (r-pygas) and a recycled content pyrolysis oil (r-pyoil), wherein at least a portion of the r-pygas is introduced into the separation zone downstream of the cracker furnace.

wherein the r-pyrolysis vapor includes at least 50, 60, 70, 80, 90, 95 volume percent of r-pygas.

wherein the r-pyrolysis vapor includes at least 10, 20, 30, 40, 50, 60, 70, 80, or 90 weight percent of r-pygas.

wherein the r-pyrolysis vapor includes less than 50, 40, 30, 20, 10, 5 volume percent of r-pyrolysis oil.

wherein the r-pyrolysis vapor includes less than 90, 80, 70, 60, 50, 40, 30, 20, or 10 weight percent of r-pyrolysis oil.

further comprising cracking at least a portion of the r-pyoil in the cracker furnace to provide a cracked effluent.

further comprising cracking at least a portion of the r-pyoil in a fluidized catalytic cracker (FCC) to provide a recycled content cracked gas (r-cracked gas).

further comprising separating at least a portion of the r-cracked gas in the separation zone downstream of the cracker furnace to provide at least one recycled content hydrocarbon product (r-product).

further comprising separating at least a portion of the cracked r-pyoil to form recycled content gasoline (r-gasoline) and recycled content diesel (r-diesel).

further comprising selling, transporting, and/or storing at least a portion of the r-pyoil.

wherein the pyrolysis facility and the cracker facility are co-located.

wherein the pyrolysis facility is remotely located from the cracker facility.

Claims not Limited to Disclosed Embodiments

The preferred forms of the invention described above are to be used as illustration only and should not be used in a limiting sense to interpret the scope of the present invention. Modifications to the exemplary embodiments, set forth above, could be readily made by those skilled in the art without departing from the spirit of the present invention.

The inventors hereby state their intent to rely on the Doctrine of Equivalents to determine and assess the reasonably fair scope of the present invention as it pertains to any apparatus not materially departing from but outside the literal scope of the invention as set forth in the following claims.

What is claimed is:

1. A process for making a recycled content hydrocarbon product (r-product), the process comprising:

(a) liquefying a plastic in a liquification zone to provide a liquified waste plastic;

(b) pyrolyzing at least a portion of the liquified waste plastic in a pyrolysis furnace of a pyrolysis facility to produce a recycled content pyrolysis vapor (r-pyrolysis vapor);

(c) introducing at least a portion of the r-pyrolysis vapor into a separation zone downstream of a cracker furnace in a cracking facility; and (d) separating at least a portion of the r-pyrolysis vapor in the separation zone to provide the recycled content hydrocarbon product, wherein at least one of following steps (i) through (iii) is also performed—

(i) passing at least a portion of a flue gas from the pyrolysis furnace and/or the cracker furnace through a carbon dioxide removal zone to recover at least a portion of the carbon dioxide;

(ii) recovering thermal energy from a flue gas from the pyrolysis furnace and/or the cracker furnace and transferring at least a portion of said thermal energy to said liquification zone; and (iii) recovering an off-gas stream from the separation zone in the cracking facility and combusting at least a portion of the off-gas stream as fuel in the pyrolysis and/or cracker furnace.

2. The process of claim 1, wherein the process further comprises step (i) passing at least a portion of a flue gas from the pyrolysis furnace and/or the cracker furnace through a carbon dioxide removal zone to capture at least a portion of the carbon dioxide.

3. The process of claim 2, wherein the carbon dioxide removal zone recovers at least 75 percent of the CO2 introduced into the carbon dioxide removal zone in the flue gas and wherein a stream of CO2-depleted off gas is withdrawn from the carbon dioxide removal zone and comprises not more than 5 mole percent CO2.

4. The process of claim 2, further comprising compressing at least a portion of the flue gas from the pyrolysis furnace and/or the cracker furnace and introducing the compressed flue gas into the carbon dioxide removal zone.

5. The process of claim 2, wherein the carbon dioxide removal zone comprises an absorber/stripper system including a liquid absorbent for removing carbon dioxide from the flue gas, wherein the liquid absorbent comprises at least one liquid selected from the group of diethanolamine, monoethanolamine, methyldiethanolamine, diisopropanolamine, diglycolamine, piperazine, sodium hydroxide, sodium carbonate, sodium bicarbonate, potassium hydroxide, potassium carbonate, potassium bicarbonate, SELEXOL®, methanol, glycol ether, and combinations thereof.

6. The process of claim 2, wherein the carbon dioxide removal zone comprises a solid CO2 absorbent, wherein the solid CO2 absorbent comprises a solid selected from the group consisting of metal oxides, metal hydroxides, molecular sieve, zeolite, activated carbon, and combinations thereof.

7. The process of claim 1, wherein the process further comprises step (ii) recovering energy from a flue gas from the pyrolysis furnace and/or from a flue gas from the cracker furnace and using at least a portion of the recovered energy to perform the liquefying of step (a).

8. The process of claim 7, wherein the recovering of step (ii) includes warming a heat transfer medium via indirect heat exchange with the flue gas and using the warmed heat transfer medium to warm at least one process stream associated with the liquefying of step (a).

9. The process of claim 1, wherein the process further comprises step (iii) recovering an off-gas stream from the cracking facility and using at least a portion of the off-gas stream as fuel in the pyrolysis and/or cracker furnace.

10. The process of claim 9, wherein the off-gas stream originates from the separation zone of the cracking facility, wherein the off-gas stream comprises at least 50 mole percent hydrogen and/or at least 50 mole percent methane.

11. The process of claim 1, prior to the liquefying of step (a), separating a stream of mixed plastic waste (MPW) into a polyolefin-enriched (PO-enriched) plastic and a polyethylene terephthalate-enriched (PET) enriched plastic in a MPW separator.

12. The process of claim 11, wherein the MPW separator is co-located with the pyrolysis facility.

13. The process of claim 11, further comprising, subjecting at least a portion of the PET-enriched plastic to solvolysis in a solvolysis facility to produce recycled content dimethyl terephthalate (r-DMT).

14. The process of claim 13, wherein the solvolysis produces one or more co-products, and further comprising introducing at least a portion of the co-products into the liquification zone, and wherein the solvolysis facility is co-located with at least one of the pyrolysis facility and the cracking facility.

15. The process of claim 11, wherein the plastic liquefied in step (a) comprises the PO-enriched plastic from the MPW separator.

16. The process of claim 1, further comprising separating at least a portion of the r-pyrolysis vapor into a recycled content pyrolysis gas (r-pygas) and a recycled content pyrolysis oil (r-pyoil), wherein at least a portion of the r-pygas is introduced into the separation zone downstream of the cracker furnace.

17. The process of claim 16, wherein the r-pyrolysis vapor includes at least 10 weight percent of r-pygas.

18. The process of claim 16, further comprising cracking at least a portion of the r-pyoil in a fluidized catalytic cracker (FCC) to provide a recycled content cracked gas (r-cracked gas) and, optionally, separating at least a portion of the r-cracked gas in the separation zone of the cracking facility.

19. The process of claim 1, wherein the pyrolysis facility and the cracking facility are co-located.

20. The process of claim 18, wherein at least one of the pyrolysis facility and the cracking facility are a commercial-scale facility.

* * * * *